US006036352A

United States Patent [19]

Sakamoto

[11] Patent Number: 6,036,352

[45] Date of Patent: Mar. 14, 2000

[54] METHOD OF AND DEVICE FOR IMPROVING THE QUALITY OF FRESH CONCRETE AND PREVENTING ADHESION AND HARDENING OF THE FRESH CONCRETE IN A MIXER DRUM OF A CONCRETE MIXER TRUCK OR OF A CONCRETE MIXING PLANT

[75] Inventor: Norio Sakamoto, Ninomiya-machi, Japan

[73] Assignee: Kabushiki Kaisha Remic-Asano, Tochigi, Japan

[21] Appl. No.: 09/059,443

[22] Filed: Apr. 14, 1998

[30] Foreign Application Priority Data

May 6, 1997 [JP] Japan ..... 9-132831
Aug. 18, 1997 [JP] Japan ..... 9-237637

[51] Int. Cl.[7] ..... B28C 5/46

[52] U.S. Cl. ..... 366/7; 366/24

[58] Field of Search ..... 366/2, 3, 4, 5, 366/7, 10, 11, 22, 24

[56] References Cited

U.S. PATENT DOCUMENTS

| | | | |
|---|---|---|---|
| 2,727,734 | 12/1955 | Vincent | 366/22 |
| 3,108,448 | 10/1963 | Hightower | 366/7 |
| 4,072,435 | 2/1978 | Coho et al. | 366/22 |
| 5,100,239 | 3/1992 | Ono et al. | 366/7 |
| 5,152,605 | 10/1992 | Yamada et al. | 366/7 |

FOREIGN PATENT DOCUMENTS

| | | | |
|---|---|---|---|
| 61-229507 | 10/1986 | Japan . | |
| 4-197705 | 7/1992 | Japan | 366/22 |
| 670662 | 6/1979 | U.S.S.R. | 366/22 |

*Primary Examiner*—Tony G. Soohoo
*Attorney, Agent, or Firm*—Wenderoth, Lind & Ponack, L.L.P.

[57] ABSTRACT

A method of and device for improving the quality of fresh concrete and preventing adhesion and hardening of the mixed fresh concrete in a rotary mixer drum of a concrete mixer truck or a stationary mixer drum of a concrete mixer plant which involves delivering selectively and continuously either cold or warm air into the mixed fresh concrete in the rotary or stationary concrete mixer drum in order to delay the hardening time of the mixed fresh concrete, and to avoid adhesion and hardening of the mixed fresh concrete on a plurality of blades and an inner periphery of the mixer drum.

16 Claims, 6 Drawing Sheets

METHOD OF AND DEVICE FOR IMPROVING THE QUALITY OF FRESH CONCRETE AND PREVENTING ADHESION AND HARDENING OF THE FRESH CONCRETE IN A MIXER DRUM OF A CONCRETE MIXER TRUCK OR OF A CONCRETE MIXING PLANT

BACKGROUND OF THE INVENTION

1. Field of the Invention

This invention relates to a method of and device for improving the quality of fresh concrete in a rotary mixer drum of a concrete mixer truck or of a concrete mixing plant. Cold or warm air is selectively and continuously delivered into a rotary mixer drum of a concrete mixer truck or into a stationary mixer drum of a concrete mixing plant during, just before, or just after unloading the fresh concrete and also just before washing the inside of the rotary mixer drum. This is done to maintain the temperature of the fresh concrete at a required temperature, and to delay a hardening time of the fresh concrete. Subsequently, water is sprayed into the rotary or stationary mixer drum, after having finished discharging the remaining fresh concrete, to wash it away before it has hardened.

2. Description of the Prior Art

Concrete is an artificial stony material which is used for foundations, etc. made by mixing cement, sand and broken stones, etc. with water, and allowing the mixture to harden. Quick hardening and solid concrete is indispensable as a building material. These solid and quick hardening properties of concrete may be disadvantageous sometimes.

As shown in FIG. 1, a conventional rotary mixer drum 20 is rotatably mounted on a chassis 10*a* of a mixer truck 10 with a hydraulic motor 12 which is linked to a gear 16 by a roller chain 14, the gear 16 being provided at a central portion of a bottom portion of the rotary mixer drum 20.

There has been an annoying problem in the conventional concrete mixer truck 10 and in the concrete mixing plant when the chemical reaction of the mixed fresh concrete advances to adhere on the plurality of rotary blades and around the inner periphery of the rotary concrete drum, etc. and hardens thereon. The concrete, once adhered and hardened on the rotary blades and the inner periphery of the rotary mixer drum 20 of the concrete mixer truck 10 and in the concrete mixing plant, is hard to scrape off.

It has been customary in the art that the remaining fresh concrete in a bottom portion of the rotary mixer drum 20 of a concrete mixer truck 10 in a concrete mixing plant is washed away by water after the fresh concrete has been discharged or unloaded out of the rotary mixer drum 20.

The temperature in the rotary mixer drum 20 rises to a range between 40–50 degrees Celsius under the blazing sun in summer, resulting in a shortened hardening time and delivery range of the fresh concrete and also decreasing the strength of the hardened concrete. In addition, when the mixed fresh concrete is unloaded out of the conventional rotary mixer drum 20 of the concrete mixer truck 10, the temperature in the rotary mixer drum 20 rises suddenly so that the remaining fresh concrete hardens in shorter time.

Moreover, inasmuch as the temperature in the rotary mixer drum 20 itself is rather high, the fact that the fresh concrete is not continuously agitated and gathers at the bottom portion of the rotary mixer drum 20 before it is unloaded, further accelerates the adhesion and hardening of the fresh concrete. To this end, even when water is sprayed into the rotary mixer drum 20 immediately after the fresh concrete has been unloaded, the remaining fresh concrete, once hardened, cannot be washed away. Accordingly, it is required that an operator must enter the rotary mixer drum 20 to scrape or tear away the hardened concrete with a hammer.

Washing by water is usually carried out immediately after the fresh concrete has been unloaded from the batcher concrete mixer, but even if washing by water is carried out, a certain amount of the adhered concrete builds up. In practice, it is necessary for the operator to scrape the adhered concrete off of the mixer drum of both the concrete mixer truck and of the concrete mixing plant once a week.

It is very dangerous for the operator to enter the mixer drum of the concrete mixer truck 10 and of the concrete mixing plant in order to scrape the adhered and hardened concrete off the mixer drum. Regrettably, a number of fatal accidents are reported every year when the rotary mixer drum 20 is carelessly rotated without knowing that the operator is within the rotary mixer drum 20 mounted on the concrete mixer truck. In order to avoid such an accident, a safety device with a sensor for detecting when the operator is within the rotary mixer drum 20 has been proposed. However, washing by water and the scraping operation by the operator within the rotary mixer drum 20 would still be required, leaving open the possibility for accidents.

It is stipulated under the JIS (the Japanese Industrial Standards) that the time between mixing fresh concrete to beginning to unload the fresh concrete must be within 90 minutes. When the time has passed 90 minutes, the temperature of the mixed fresh concrete has risen, causing the fresh concrete to deteriorate due to the high temperature and shortening the delivery range. Accordingly, the fresh concrete, thus mixed, is likely to be refused by a user as the product is below the standards. It is said that concrete mixing and transporting are a battle against time.

In another embodiment, cooling systems or refrigerators using liquified gas have been proposed to cool the fresh concrete temporarily so that the strength of the placed concrete is increased, cracking of the deposited concrete is prevented and the quality of the concrete is maintained. Among them are many cooling systems in which the fresh concrete is directly cooled prior to transportation. One of the conventional cooling systems is characterized in that the fresh concrete is cooled at a building site or a construction field.

Mounted on the concrete mixer truck 10 is another conventional cooling system in which liquified gas is directly injected into the fresh concrete (see Japanese Patent Publication No. 2295-07/1986, not-examined). It should be appreciated, however, that liquified gas is very expensive, and although it may be suitable for a temporary cooling of fresh concrete, a large amount of liquified gas is required for continuous cooling during transportation.

Another embodiment has been proposed, wherein flakes of crushed ice are mixed into fresh concrete in a rotary mixer drum, but there is a disadvantage. When the flakes of crushed ice remain in the fresh concrete at the time of placing the fresh concrete, openings or gaps occur in the fresh concrete as a result of the crushed ice, thus deteriorating the strength of the hardened concrete.

On the other hand, when the rotary mixer drum 20 is exposed to the open air in a cold season, dropping the temperature in the rotary mixer drum, the strength of the mixed fresh concrete decreases. In order to eliminate this disadvantage, a countermeasure has been worked out in which the mixture ratio of the cement is changed in accordance with the temperature of the open air. However, the mixing adjustment is very troublesome, and the material costs increase as well. Adhesion and hardening of the remaining cement in the rotary mixer drum also occurs in the cold season even though the temperature is low.

SUMMARY OF THE INVENTION

A principal object of this invention is to provide a method of improving the quality of fresh concrete and preventing adhesion and hardening of fresh concrete on a plurality of rotary blades and around an inner periphery of a mixer drum of a concrete mixer truck and/or of a concrete mixing plant. Cold or warm air is selectively and continuously delivered into the rotary mixer drum to maintain the temperature of the fresh concrete at a required temperature range, to delay the hardening time of the fresh concrete and to extend the delivery range thereof.

Another object of this invention is to provide a device for improving the quality of fresh concrete and preventing adhesion and hardening of fresh concrete on a plurality of rotary blades and around an inner periphery of a mixer drum of a concrete mixer truck and/or of a concrete mixing plant. Cold or warm air is selectively and continuously delivered into the mixer drum to maintain the temperature of the fresh concrete within a required temperature range, to delay the hardening time of the fresh concrete and to extend the delivery range thereof.

Another object of this invention is to provide a method for improving the quality of fresh concrete and preventing adhesion and hardening of fresh concrete on a plurality of rotary blades and around an inner periphery of a mixer drum of a concrete mixer truck and/or of a concrete mixing plant. Cold or warm air is continuously delivered into the mixer drum to maintain the temperature of the fresh concrete at a required low temperature range, to delay the hardening time of the fresh concrete and to extend the delivery range thereof.

Another object of this invention is to provide a device whereby long distance transportation of the fresh concrete can be carried out easily without deteriorating the quality of fresh concrete and preventing adhesion and hardening of the fresh concrete on an inner periphery of a mixer drum of a concrete mixer truck and/or of a concrete mixing plant.

Another object of this invention is to provide a device whereby the amount of time for transporting the fresh concrete in the rotary mixer drum can be increased for as long as possible without using a concrete mixing relay base.

Another object of this invention is to provide a device whereby washing by water of the remaining fresh concrete in a mixer drum of a concrete mixer truck and/or a concrete mixing plant can be carried out easily and safely so that a scraping operation of the adhered concrete by an operator in the rotary mixer drum can be discontinued, thus avoiding a potentially fatal accident.

Another object of this invention is to provide a device for manufacturing fresh concrete in a rotary mixer drum of a concrete mixer truck whereby the fresh concrete can be manufactured even in a region where neither a fresh mixing plant nor a concrete mixing relay base is located, thus enabling the manufacturing of fresh concrete effectively, without needing to bring concrete material such as sand, cement and water separately.

Another object of this invention is to provide a device whereby only cold air is delivered into a rotary mixer drum of a concrete mixer truck to prevent adhesion of the remaining fresh concrete after most of the fresh concrete has been discharged.

Another object of this invention is to provide a device whereby the placing of fresh concrete can be carried out at either high or low temperature.

Another object of this invention is to provide a device for preventing adhesion and hardening of fresh concrete in a rotary mixer drum of a concrete mixer truck wherein a part or whole portion of the exterior casing of the rotary mixer drum is covered with removable heat insulating material.

Still another object of this invention is to provide a device for preventing adhesion and hardening of fresh concrete in a rotary mixer drum of a concrete mixer truck having a compact and simple hot and cold air blower which can be easily manufactured and mounted on a rotary mixer truck at a reasonable price.

BRIEF DESCRIPTION OF THE DRAWINGS

These and other objects, features, and advantages of this invention will become more apparent from the following description of the preferred embodiments taken in conjunction with the accompanying drawings, in which.

DETAILED DESCRIPTION OF PREFERRED EMBODIMENTS

This invention is concerned with a method and device for preventing adhesion and hardening of fresh concrete in a rotary mixer drum of a concrete mixer truck.

Figure 1:
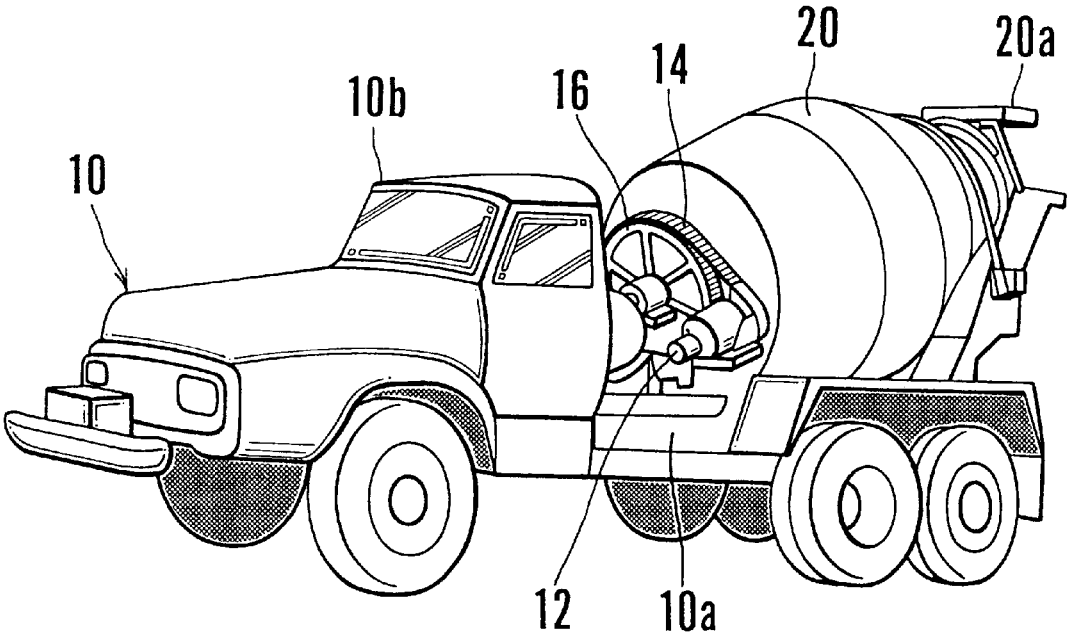
FIG. 1 (PRIOR ART)
FIG. 1 is a perspective view of a conventional rotary mixer drum mounted on a concrete mixer truck.
Figure 2:
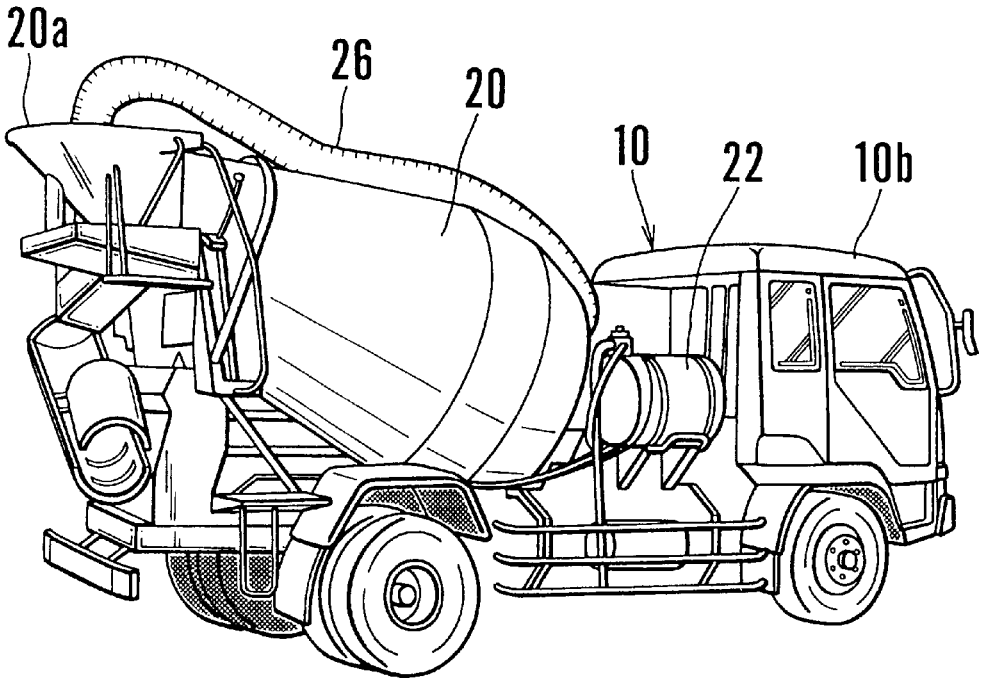
FIG. 2 is a perspective view of a rotary concrete mixer in accordance with this invention, seen from the back position.
Figure 3:
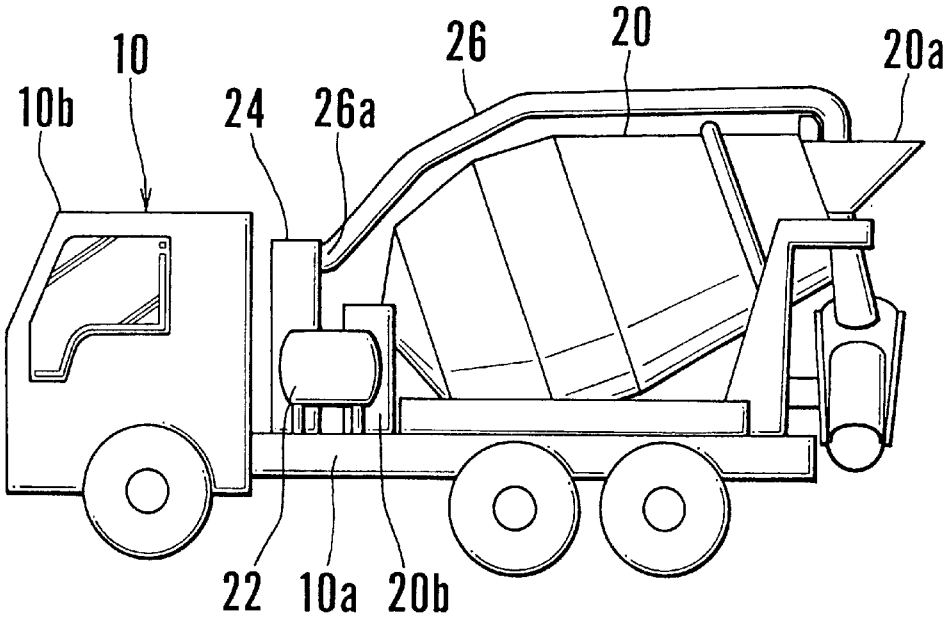
FIG. 3 is a side elevation of the rotary concrete mixer shown in FIG. 2.
Figure 4:
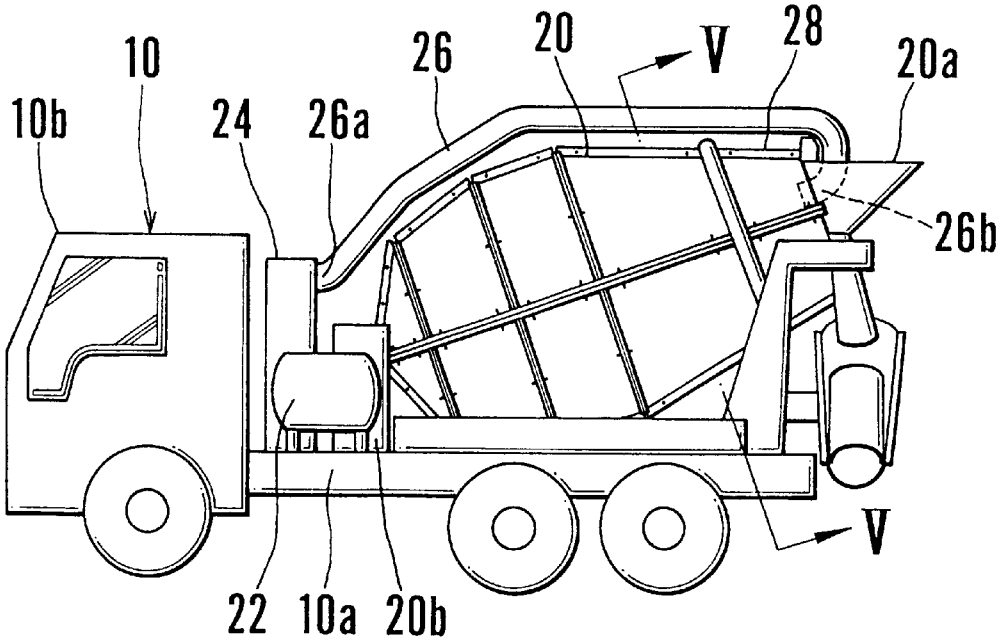
FIG. 4 is a side elevation of the rotary concrete mixer, which is similar to FIG. 3, with a rotary mixer drum being partially cut away.
Figure 5:
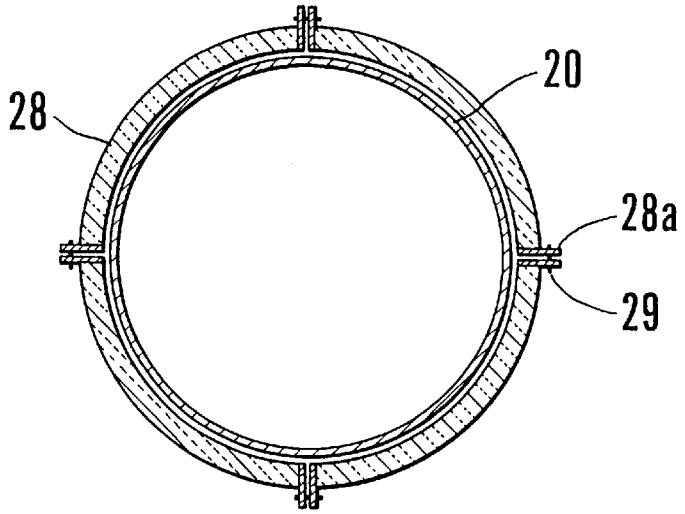
FIG. 5 is an enlarged partial sectional view, taken along the lines V—V of FIG. 4.
Figure 6:
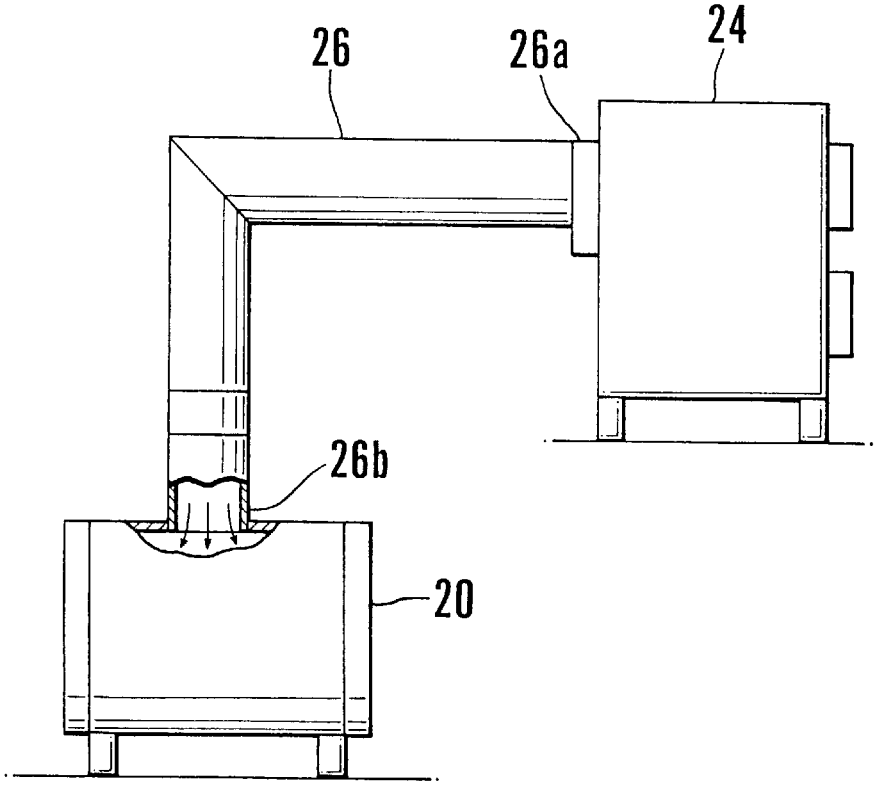
FIG. 6 is a front elevation of an air conditioner for supplying cold air into a concrete mixing plant.

Referring to FIGS. 2–4, a blower 24 is mounted on a chassis 10*a* of a concrete mixer truck 10 located between a driver's cab 10*b* and a rotary mixer drum 20 for continuously blowing cold air in the mixed fresh concrete in the rotary mixer drum 20. A water tank 22 is provided on the chassis boa to wash the inner periphery of the rotary mixer drum 20.

Located above and adjacent to the rotary mixer drum 20 is a blower duct 26, one end portion 26*a* of which is connected to the blower 24 and another end portion 26*b* of which partially enters the hopper 20*a* of the rotary mixer drum 20. A temperature sensor or thermometer (not shown) is provided at one end portion 26*b* of the air duct 26 in order to take the inner temperature of the rotary mixer drum 20. When detected by the temperature sensor that the temperature of the mixed fresh concrete in the rotary mixer drum 20 has risen over the predetermined range, the blower 24 is driven to deliver cold air to reduce the temperature and to maintain the predetermined range (between about 1 degree C. and about 15 degrees C.).

It should be understood that when the open air temperature outside the rotary mixer drum 20 is 28 degrees C. and the temperature in the rotary mixer drum 20 rises to about 15 degrees C., the air blower 24 is driven to deliver cold air for dropping the temperature by about 3 degrees C., thus maintaining the temperature in the rotary mixer drum 20 at about 12 degrees C. When the open air temperature outside the rotary mixer drum 20 is about 12 degrees C., and the temperature in the rotary mixer drum 20 rises over that of the open air, and unless any measure is taken, the temperature in the rotary mixer drum 20 will rise over 15 degrees C., so that even if the open air temperature is below 15 degrees C., the air blower 24 is driven to deliver cold air into the rotary mixer drum 20.

In the summer, the daytime open air temperature outside the rotary drum mixer 20 is usually higher than 15 degrees C. On the other hand, the open air temperature outside the rotary mixer drum 20 is likely to be lower than inside the rotary mixer drum 20 in the winter. Accordingly, the cooling temperature of the air blower 24 is mechanically set to −10 degrees C. during the season between May and October with the rotary mixer drum 20 covered with a heat insulating material without using a temperature control such as the temperature sensor, and the set cooling temperature may be set to −5 degrees C. during the season between November and April. It is also possible to choose a more detailed temperature setting.

The one end portion 26*b* of the air duct 26 must be located in the upper portion of the rotary mixer drum 20 so that cold air flows downwardly into the rotary mixer drum 20 in order to cool the whole inner periphery thereof. It should be appreciated that when cold air is delivered into the fresh concrete in the rotary mixer drum 20 of the conventional agitator type concrete mixer truck (see the Japanese Patent Publication No. 229507/1986, not examined), air bubbles may be introduced into the fresh concrete, thus deteriorating the strength of the fresh concrete. Therefore, the one end portion 26*b* of the air duct 26 must not be located at the intermediate or bottom portion of the rotary mixer drum 20.

The air blower 24 can be driven by a domestic electric power source or by an automobile engine so that continuous cooling may be carried out. The cost of producing cold air by using an electric power source or automobile engine is substantially less than that of using liquified gas. As a result, it becomes possible to carry out long term continuous cooling for the fresh concrete in accordance with the agitation type concrete mixer truck where the rotary mixer drum 20 is rotatably mounted and driven by the truck engine (not shown).

The invention brings about another advantage, in that even if the mixed fresh concrete is transported for a number of hours, deterioration of the fresh concrete can be prevented. Without cooling, the temperature in the rotary mixer drum 20 can rise above 40 degrees C. under direct sunlight in the summer.

As shown in FIGS. 5–8, a heat insulating material 28 covering the outer periphery of the rotary mixer drum 20 will prevent the temperature from rising, help decrease the load on the motor of the air blower 24 and decrease energy consumption as well. The heat insulating material 28 is not required for the rotary mixer drum 20 during the low temperatures of winter. As a result, it is preferable to detachably wind the heat insulating material 28 around the rotary mixer drum 20. In order to apply the heat insulating material, a monkey belt including a vinyl sheet 28*b*, a plurality of long and narrow heat insulating material pieces 28*c* made of polystyrol pasted on the vinyl sheet 28*b*, and several fixing means such as hooks or adhesive tape 28*d* provided along one end portion of the vinyl sheet 28*b*, is wound around the rotary mixer drum 20. A bottom portion of the rotary mixer drum 20, which is not exposed to the sunlight, is not covered with the heat insulating material 28, but a side peripheral portion and an upper peripheral portion are covered with the heat insulating material to have a remarkable heat insulating effect.

Figure 7:
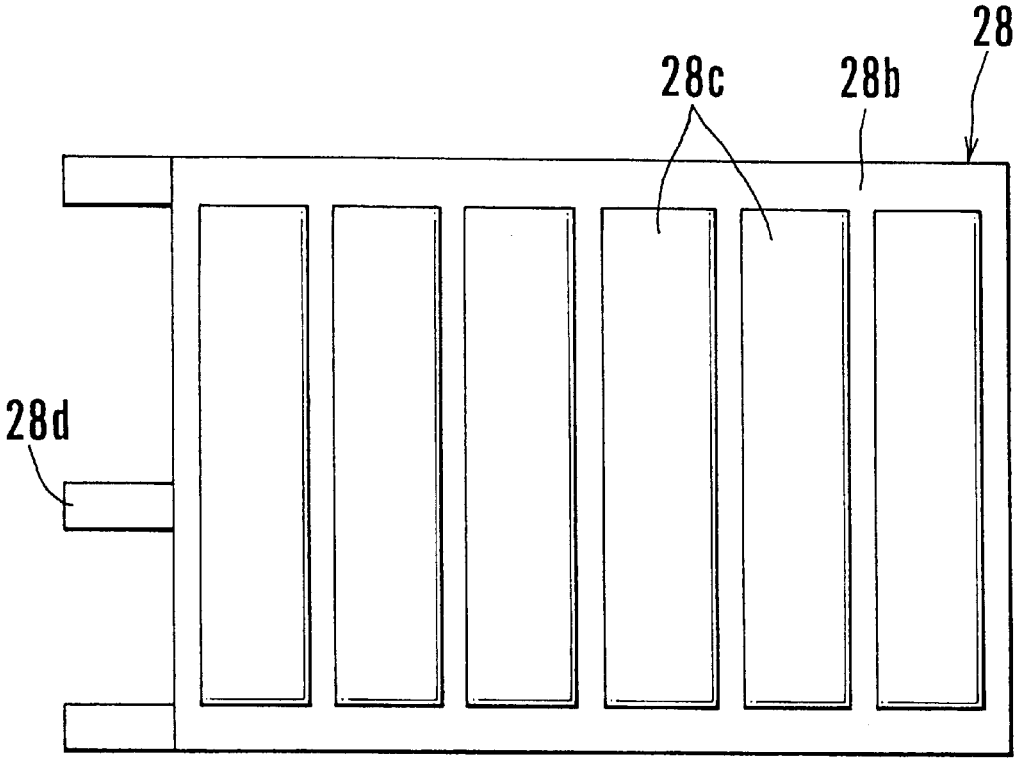
FIG. 7 is a plan view of a heat insulating material covering a rotary mixer drum and an air blast duct of this invention.
Figure 8:
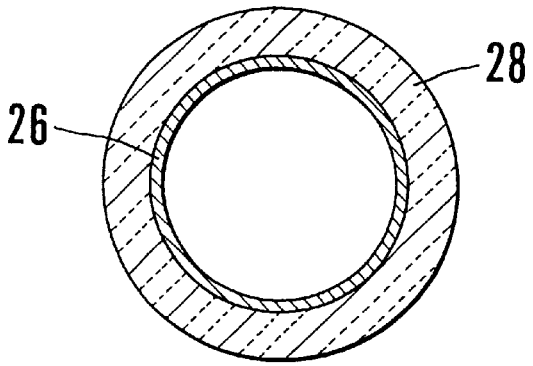
FIG. 8 is an enlarged partial sectional view showing an air supplying device of another embodiment of this invention.

As shown in FIGS. 7 and 8, the heat insulating material 28 made of polystyrol is wound around the air duct 26 in order to prevent a rise in temperature and to increase energy efficiency. A water tank 22 is mounted on the concrete mixer truck 10 to wash away the inner periphery of the rotary mixer drum 20.

In accordance with this invention, cold air is continuously delivered into the rotary mixer drum 20 to maintain the inside temperature less than 15 degrees C. so that the hardening time of the mixed fresh concrete may be remarkably delayed.

Figure 9:
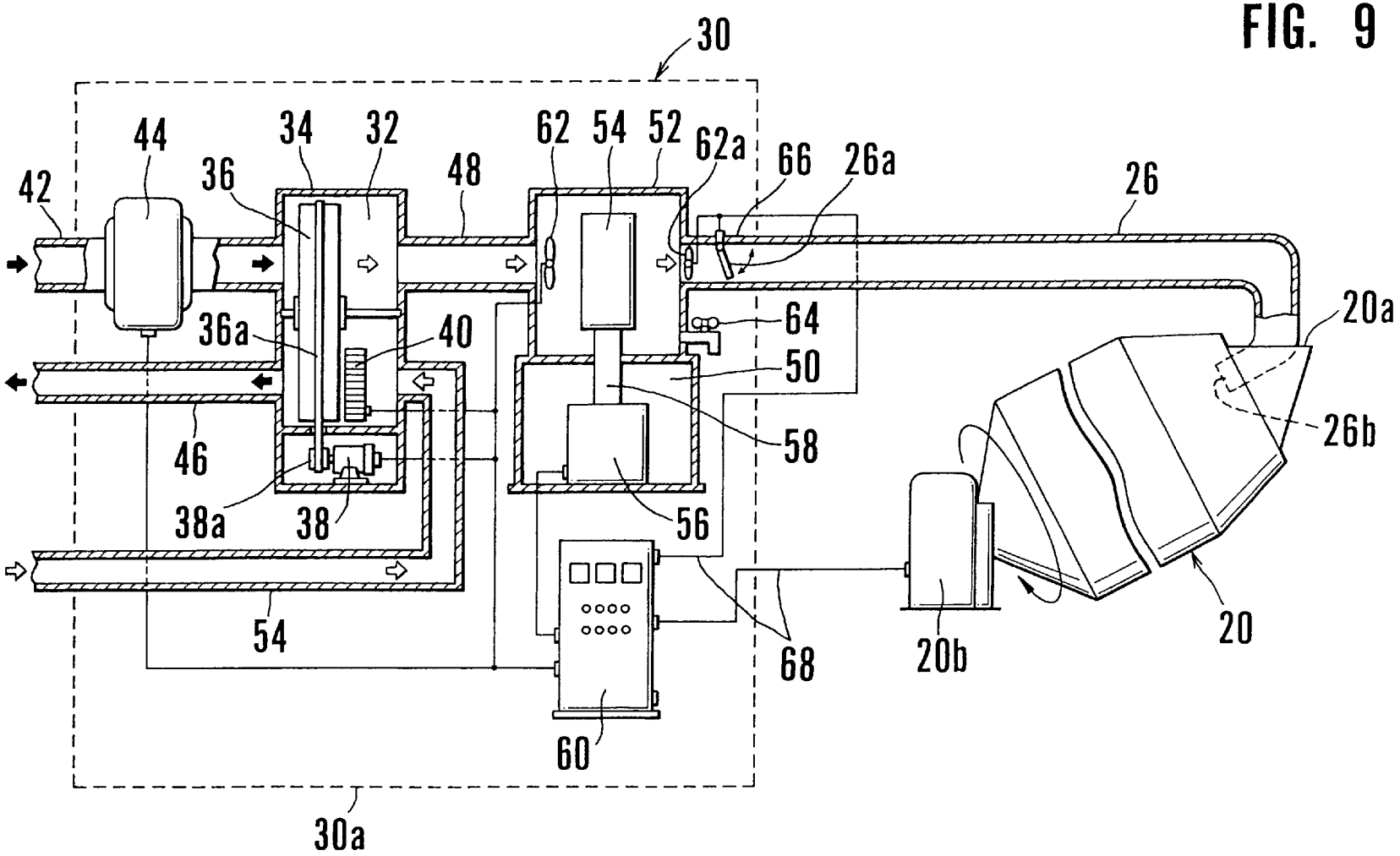
FIG. 9 is an enlarged sectional view of a cold and warm air blower mounted on an agitation type rotary concrete mixer.

In FIG. 9, there is shown another embodiment of a cold and warm air blower 30 instead of the blower 24 described in the foregoing paragraphs. More particularly, the cold and warm air blower 30 is rotatably mounted on an agitation rotary concrete mixer 10 which includes a casing 30*a* comprising a dehumidifier 34 located in a casing 32 and having a rotary dehumidifying plate 36 driven by a pulley 36*a* engaged with the plate 36 and a driving gear 38*a* of a motor 38.

The casing 32 also contains a heater 40 located near the rotary dehumidifying plate 36. An intake pipe 42 having a compressor 44 at its middle portion and an exhaust pipe 46 are both connected to an outside plate of the casing 32. Another intake pipe 54 is connected to another outside plate of the casing 32 to face the heater 40.

The dehumifidier 34 is connected through a duct 48 to a casing 52 of an air conditioner 50 which comprises a heat exchanger 54 located at an upper portion of the casing 52 and a base operating unit 56 provided at a lower portion of the casing 52, both the heat exchanger 54 and the base operating unit 56 being connected with each other by a duct 58. The base operating unit 56 comprises a compressor, motor, and refrigerant container (not shown). A control panel 60 is connected to the base operating unit 56 by an electrical wire 68. A duct fan 62 is provided at a connected portion of the duct 48 and the casing 52.

One end portion 26*a* of the blower duct 26 penetrates through the casing 32 to connect with the casing 52 of the air conditioner 50. Another duct fan 62*a* is provided at a connected portion of the casing 52 and the blower duct 26, and a damper 66 is provided into the blower duct 26 to locate near the duct fan 62*a*. Another end portion 26*b* of the blower duct 26 is extended to enter partially a hopper 20*a* of the rotary mixer drum 20.

A drain cock 64 is provided at a bottom portion of the casing 52. The control panel 60 is also connected to the driving unit 20*b*, duct fans 62, 62*a*, motor 38, heater 40 and compressor 44 by electrical wire 68.

Figure 10:
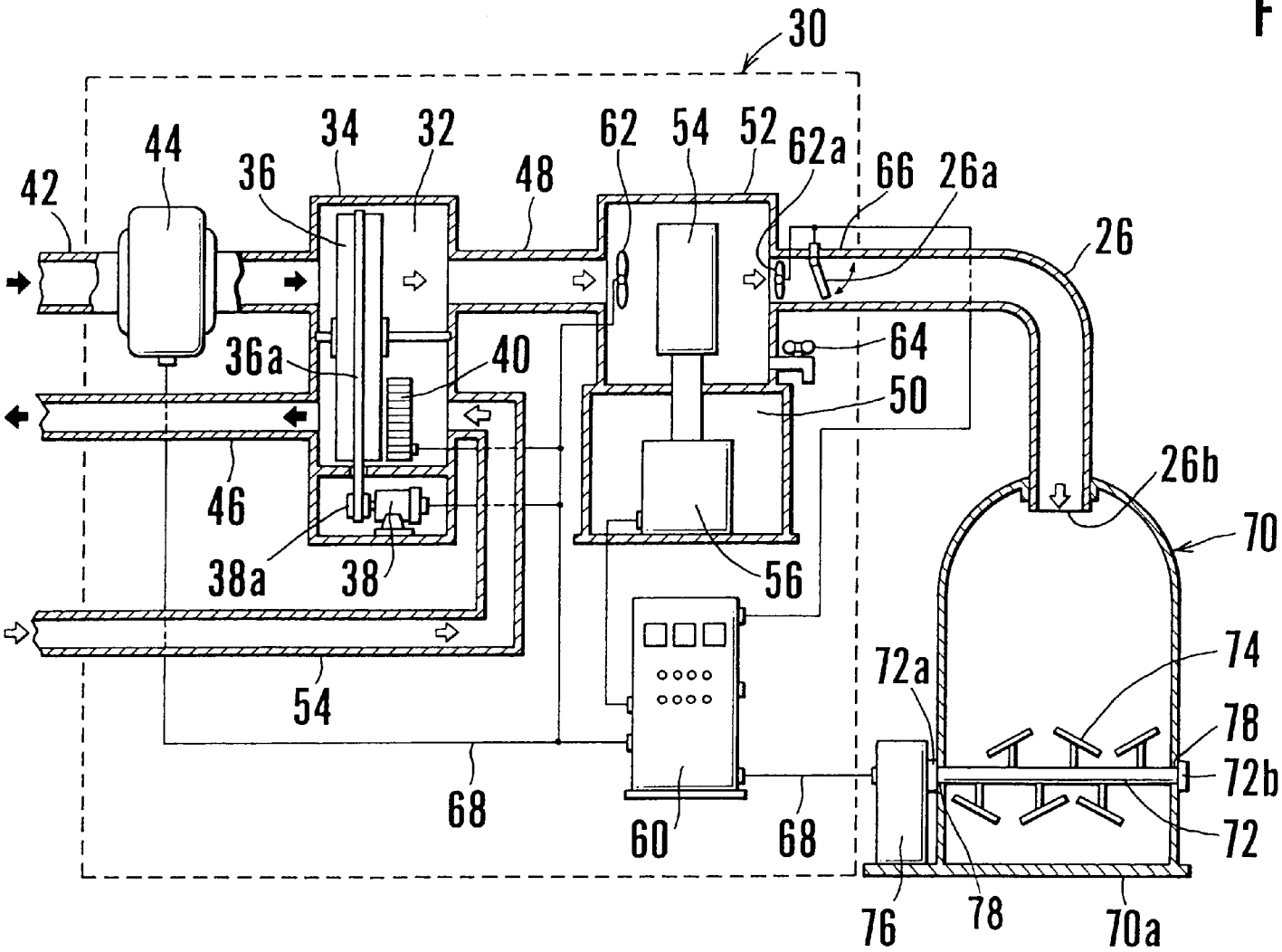
FIG. 10 is an enlarged sectional view of a cold and hot air blower mounted on a batcher concrete rotary concrete mixing plant.

In FIG. 10, another cold and warm air blower 30 is mounted on a batcher plant (not shown) which includes a dehumidifier 34, an air conditioner 50 and other units which are the same as those of the example shown in FIG. 9, but a stationary concrete mixing tank 70 is mounted on the batcher plant.

It can be understood from the drawing that a rotatable shaft 72 having a plurality of agitators 74 around the shaft 72 extends horizontally near a bottom portion 70*a* of the stationary concrete mixing tank 70 to penetrate its outer end portions 72*a*, 72*b* through a pair of openings 78, one end portion 72*a* being linked to a driving unit 76 provided on the bottom portion 70*a* and linked to the control panel 60 by the electrical wire 68.

Owing to the season and local outer temperature, either cold or warm air is selectively delivered into the rotary concrete mixer drum 20 of the agitation concrete mixer truck 10 or the stationary mixer tank 70 of the batcher plant, thus maintaining the temperature of the mixed fresh concrete within a predetermined range, maintaining the quality of the mixed fresh concrete, and delaying the hardening time of the mixed fresh concrete.

The method and device of this invention can increase the time for transporting the fresh concrete without using a concrete mixing relay base, and at the same time, the ordinary scraping operation of the adhered concrete by the operator in the rotary mixer drum 20 can be discontinued.

It should be understood that changes and modifications to the preferred embodiment described above will be apparent to those skilled in the art. It is intended that the foregoing description be regarded as illustrative rather than limiting, and that it is the following claims, including all equivalents thereof, which are intended to define the scope of the invention.

What is claimed is:

1. A method of preventing adhesion and hardening of mixed fresh concrete on a plurality of rotary blades and an inner periphery of a mixer drum which comprises:

(a) delivering continuously cold air into the mixed fresh concrete in the mixer drum when the open air temperature outside the mixer drum is high;

(b) delivering continuously warm air into the mixed fresh concrete in the mixer drum when the open air temperature outside the mixer drum is low in order to maintain the temperature of the mixed fresh concrete within a predetermined range and to delay a hardening time of the mixed fresh concrete; and (c) spraying water into the mixer drum.

2. A method of preventing adhesion and hardening of mixed fresh concrete as claimed in claim 1, wherein said delivering continuously cold or warm air into the mixer drum occurs just before, during, or just after unloading the mixed fresh concrete and also just before washing the inner periphery of the mixer drum.

3. A method of preventing adhesion and hardening of mixed fresh concrete as claimed in claim 1, wherein the continuously cold or warm air is dehumidified.

4. A device for preventing adhesion and hardening of mixed fresh concrete on a plurality of rotary blades and an inner periphery of a mixer drum which comprises:

(a) an air blower;

(b) a blower duct provided on said mixer drum, one end portion of said blower duct being connected to said air blower, and another end portion located to partially enter the mixer drum; and (c) a water tank operatively connected to the mixer drum for supplying water thereto.

5. A device for preventing adhesion and hardening of mixed fresh concrete on a plurality of rotary blades and an inner periphery of a mixer drum as claimed in claim 4, wherein said blower duct and the mixer drum have removable heat insulating material covering an outer periphery of said blower duct and the mixer drum.

6. A device for preventing the adhesion and hardening of mixed fresh concrete on a plurality of rotary blades and an inner periphery of a mixer drum as claimed in claim 5, wherein said heat insulating material is made of polystyrol.

7. A device for preventing adhesion and hardening of mixed fresh concrete on a plurality of rotary blades and an inner periphery of a mixer drum as claimed in claim 6, wherein the mixer drum, said air blower, said blower duct and said water tank are mounted on a concrete mixer truck, the mixer drum is a rotary mixer drum, and said water tank is mounted on said concrete mixer truck between a driver's cab and said rotary mixer drum.

8. A device for preventing adhesion and hardening of mixed fresh concrete on a plurality of rotary blades and an inner periphery of a mixer drum as claimed in claim 6, wherein the mixer drum, said air blower, said blower duct and said water tank are within a batcher plant, and the mixer drum is a stationary mixer drum.

9. A device for preventing adhesion and hardening of mixed fresh concrete on a plurality of rotary blades and an inner periphery of a mixer drum as claimed in claim 5, wherein said air blower further comprises:

(a) an air blower casing which comprises a dehumidifier located in a dehumidifier casing and having a rotary dehumidifying plate driven by a pulley engaged with said rotary dehumidifying plate and a driving gear of a motor, a heater located near said rotary dehumidifying plate, an intake pipe having a compressor at its middle portion and an exhaust pipe, both being connected at an outside plate of said dehumidifier casing, another intake pipe connected to another outside plate of said dehumidifier casing facing said heater, said dehumidifier connected through a duct to a casing of an air conditioner;

(b) said air conditioner comprising a heat exchanger located at an upper portion of said casing of said air conditioner and a base operating unit provided at a lower portion of said casing of said air conditioner, both of said heat exchanger and said base operating unit being connected with each other by an air conditioner duct;

(c) said base operating unit comprising an air conditioner motor and a refrigerant container;

(d) a control panel electrically connected to said base operating unit; and (e) a duct fan provided at a portion connecting said duct and a side of said casing of said air conditioner, one end portion of said duct penetrating through said dehumidifier casing to connect with said casing of said air conditioner, another duct fan provided at another portion connecting another side of said casing of said air conditioner and said blower duct, a damper provided within said blower duct located near said another duct fan, another end portion of said blower duct extending to partially enter the mixer drum, a drain cock provided at a bottom portion of said upper portion of said casing of said air conditioner, said control panel being electrically connected to a driving unit associated with said mixer drum, said duct fan, said another duct fan, said motor, said heater, and said compressor.

10. A device for preventing adhesion and hardening of mixed fresh concrete on a plurality of rotary blades and an inner periphery of a mixer drum as claimed in claim 9, wherein the mixer drum, said air blower, said blower duct and said water tank are mounted on a concrete mixer truck, the mixer drum is a rotary mixer drum, and said water tank is mounted on said concrete mixer truck between a driver's cab and said rotary mixer drum.

11. A device for preventing adhesion and hardening of mixed fresh concrete on a plurality of rotary blades and an inner periphery of a mixer drum as claimed in claim 9, wherein the mixer drum, said air blower, said blower duct and said water tank are within a batcher plant, the mixer drum is a stationary mixer drum, and said stationary mixer drum contains a rotatable shaft extending horizontally near a bottom portion of said stationary mixer drum, said rotatable shaft having end portions which penetrate said stationary mixer drum, an end portion of said rotatable shaft being connected to said driving unit, and a plurality of agitators being located around said rotatable shaft.

12. A device for preventing adhesion and hardening of mixed fresh concrete on a plurality of rotary blades and an inner periphery of a mixer drum as claimed in claim 4, wherein said air blower further comprises:

(a) an air blower casing which comprises a dehumidifier located in a dehumidifier casing and having a rotary dehumidifying plate driven by a pulley engaged with said rotary dehumidifying plate and a driving gear of a motor, a heater located near said rotary dehumidifying plate, an intake pipe having a compressor at its middle portion and an exhaust pipe, both being connected at an outside plate of said dehumidifier casing, another intake pipe connected to another outside plate of said dehumidifier casing facing said heater, said dehumidifier connected through a duct to a casing of an air conditioner;

(b) said air conditioner comprising a heat exchanger located at an upper portion of said casing of said air conditioner and a base operating unit provided at a lower portion of said casing of said air conditioner, both of said heat exchanger and said base operating unit being connected with each other by an air conditioner duct;

(c) said base operating unit comprising an air conditioner motor and a refrigerant container;

(d) a control panel electrically connected to said base operating unit; and (e) a duct fan provided at a portion connecting said duct and a side of said casing of said air conditioner, one end portion of said duct penetrating through said dehumidifier casing to connect with said casing of said air conditioner, another duct fan provided at another portion connecting another side of said casing of said air conditioner and said blower duct, a damper provided within said blower duct located near said another duct fan, another end portion of said blower duct extending to partially enter the mixer drum, a drain cock provided at a bottom portion of said upper portion of said casing of said air conditioner, said control panel being electrically connected to a driving unit associated with said mixer drum, said duct fan, said another duct fan, said motor, said heater, and said compressor.

13. A device for preventing adhesion and hardening of mixed fresh concrete on a plurality of rotary blades and an inner periphery of a mixer drum as claimed in claim 12, wherein the mixer drum, said air blower, said blower duct and said water tank are mounted on a concrete mixer truck, the mixer drum is a rotary mixer drum, and said water tank is mounted on said concrete mixer truck between a driver's cab and said rotary mixer drum.

14. A device for preventing adhesion and hardening of mixed fresh concrete on a plurality of rotary blades and an inner periphery of a mixer drum as claimed in claim 12, wherein the mixer drum, said air blower, said blower duct and said water tank are within a batcher plant, the mixer drum is a stationary mixer drum, and said stationary mixer drum contains a rotatable shaft extending horizontally near a bottom portion of said stationary mixer drum, said rotatable shaft having end portions which penetrate said stationary mixer drum, an end portion of said rotatable shaft being connected to said driving unit, and a plurality of agitators being located around said rotatable shaft.

15. A device for preventing adhesion and hardening of mixed fresh concrete on a plurality of rotary blades and an inner periphery of a mixer drum as claimed in claim 4, wherein the mixer drum, said air blower, said blower duct and said water tank are mounted on a concrete mixer truck, the mixer drum is a rotary mixer drum, and said water tank is mounted on said concrete mixer truck between a driver's cab and said rotary mixer drum.

16. A device for preventing adhesion and hardening of mixed fresh concrete on a plurality of rotary blades and an inner periphery of a mixer drum as claimed in claim 4, wherein the mixer drum, said air blower, said blower duct and said water tank are within a batcher plant, and the mixer drum is a stationary mixer drum.

* * * * *